US007207655B2

(12) United States Patent
Delametter et al.

(10) Patent No.: US 7,207,655 B2
(45) Date of Patent: Apr. 24, 2007

(54) LATENCY STIRRING IN FLUID EJECTION MECHANISMS

(75) Inventors: Christopher N. Delametter, Rochester, NY (US); Alok Verma, Rochester, NY (US); David P. Trauernicht, Rochester, NY (US); Thomas M. Stephany, Churchville, NY (US)

(73) Assignee: Eastman Kodak Company, Rochester, NY (US)

( * ) Notice: Subject to any disclaimer, the term of this patent is extended or adjusted under 35 U.S.C. 154(b) by 284 days.

(21) Appl. No.: 10/878,097

(22) Filed: Jun. 28, 2004

(65) Prior Publication Data

US 2005/0285912 A1 Dec. 29, 2005

(51) Int. Cl.
*B41J 2/04* (2006.01)

(52) U.S. Cl. ..... 347/54

(58) Field of Classification Search ..... 347/44, 347/46, 56, 61, 68

See application file for complete search history.

(56) References Cited

U.S. PATENT DOCUMENTS

| | | | | |
|---|---|---|---|---|
| 4,358,781 | A * | 11/1982 | Yamamori et al. | 347/21 |
| 6,039,442 | A | 3/2000 | Hagiwara et al. | |
| 6,055,002 | A * | 4/2000 | Wen et al. | 346/140.1 |
| 6,172,693 | B1 * | 1/2001 | Minemoto et al. | 347/55 |
| 6,328,421 | B1 * | 12/2001 | Kojima et al. | 347/46 |
| 6,682,189 | B2 | 1/2004 | May et al. | |
| 6,695,441 | B2 | 2/2004 | Asano | |
| 6,964,470 | B2 * | 11/2005 | Kagami | 347/55 |

* cited by examiner

*Primary Examiner*—Anh T. N. Vo
(74) *Attorney, Agent, or Firm*—William R. Zimmerli

(57) ABSTRACT

A liquid drop emitter, a method of mixing a liquid, and a method of printing are provided. The liquid emitter includes a structure defining a chamber adapted to provide a liquid having an orifice through which a drop of the liquid can be emitted. A drop forming mechanism is operatively associated with the chamber. A mixing mechanism is associated with the chamber and is operable to create a surface tension gradient on the liquid provided by the chamber such that the liquid flows without being emitted from the chamber.

54 Claims, 7 Drawing Sheets

LATENCY STIRRING IN FLUID EJECTION MECHANISMS

FIELD OF THE INVENTION

The present invention relates generally to the field of inkjet printing but more specifically to the surface tension induced stirring of liquids that are to be ejected by a liquid ejection mechanism.

BACKGROUND OF THE INVENTION

The problems associated with the premature drying of liquids such as inks, within fluid delivery devices such as inkjet printers, are known. The premature drying of liquids causes the plugging of ejection nozzles that will either impede or totally prevent liquids from being delivered through the nozzle and onto a desired delivery medium. The plugging that occurs within liquid ejection nozzles has created a need for methods that remove such blockages, such as purging of the nozzles.

Those skilled in the art of inkjet printers are aware that software exists to verify the proper operation of liquid ejection nozzles. The software also provides various routines to exercise those nozzles to purge them of dried or drying liquids. A significant drawback to purging of nozzles within fluid ejection systems exists in that the purged fluids must be deposited somewhere. This is typically accomplished by depositing the purged fluids into a sponge. However, purging receptacles such as sponges and the like have limited storage volume and become full requiring costly and often inconvenient service requirements. Service, the replacement of sponges, and the use of cleaning cycles increases the cost of printing and adds to the complexity of printer mechanisms. Additionally, full and saturated receptacles can contaminate the very nozzles that you are trying to clean, by virtue of cross-contaminating wet sponge material into nozzles that are already clean.

Also, in typical printing applications, the image-wise requirement of placing ink droplets upon a receiver will leave certain nozzles unused. This exacerbates the drying of ink within the unused nozzles, because of the rapid reciprocation of the print head. The additional motion enhances the movement of air over the nozzles, and thus directly increases the rate of the evaporation of the fluids waiting to be ejected. Additionally, inks, including dye and pigment based inks, exhibit unique physical drying properties based upon their individual formulations, with the rate of those drying properties being accelerated when the ink is idle and exposed to the atmosphere at the meniscus of an ejector nozzle.

U.S. Pat. No. 6,695,441 B2, issued to Asano on Feb. 24, 2004, discloses a stirring device that utilizes an ultrasonic transducer that applies ultrasonic vibrations to ink in order to overcome problems such as molecular over-concentration due to molecular coupling, the sedimentation of suspended particles and the cohesion of particles within an ink. Asano teaches that the molecular-weight distribution of inks increases because of molecular clumping and causes erratic or clogged ink nozzles, and additionally that the practice of simple ink stirring does not sufficiently address problems such as sedimentation or cohesion, those types of problem being solved by the aggressive method of using a complicated and costly ultrasonic device.

U.S. Pat. No. 6,172,693 B1, issued to Minemoto et al. on Jan. 9, 2001, also discloses a method of stirring a fluid. This method discusses a plurality of electrophoretic electrodes that react with the polarity of particles that are suspended within a fluid. These particles in turn correspond with and react to a plurality of ejecting electrodes whose functions are also based upon the polarity of the suspended particles. Stirring electrodes that are disposed in proximity to the ejecting electrodes serve to stir the polarity-based color particles that are suspended within the fluid carrier that delivers those particles to the ejecting electrodes. This charge-based stirring of the suspended particles promotes proper dispersion of the particles in the area of an ejection port, thus preventing those particles from plugging the ejection port and blocking their ejection, the ejection of a particle being accomplished by virtue of electrophoresis.

SUMMARY OF THE INVENTION

According to one feature of the present invention, a liquid emitter includes a structure defining a chamber adapted to provide a liquid and has an orifice through which a drop of the liquid can be emitted. A drop forming mechanism is operatively associated with the chamber. A mixing mechanism is associated with the chamber and is operable to create a surface tension gradient on the liquid provided by the chamber such that the liquid flows without being emitted from the chamber.

According to another feature of the present invention, a method of mixing a liquid includes providing a liquid in a chamber having an orifice through which a drop of the liquid can be emitted; and creating a surface tension gradient on the liquid provided by the chamber, wherein the liquid flows without being emitted from the chamber.

According to another feature of the present invention, a method of printing includes providing a liquid in a chamber having an orifice through which a drop of the liquid can be emitted; providing a drop forming mechanism operatively associated with the chamber; mixing the liquid in the chamber by creating a surface tension gradient on the liquid provided by the chamber such that the liquid flows without being emitted from the chamber; and ejecting a drop of the liquid from the orifice of the chamber using the drop forming mechanism.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
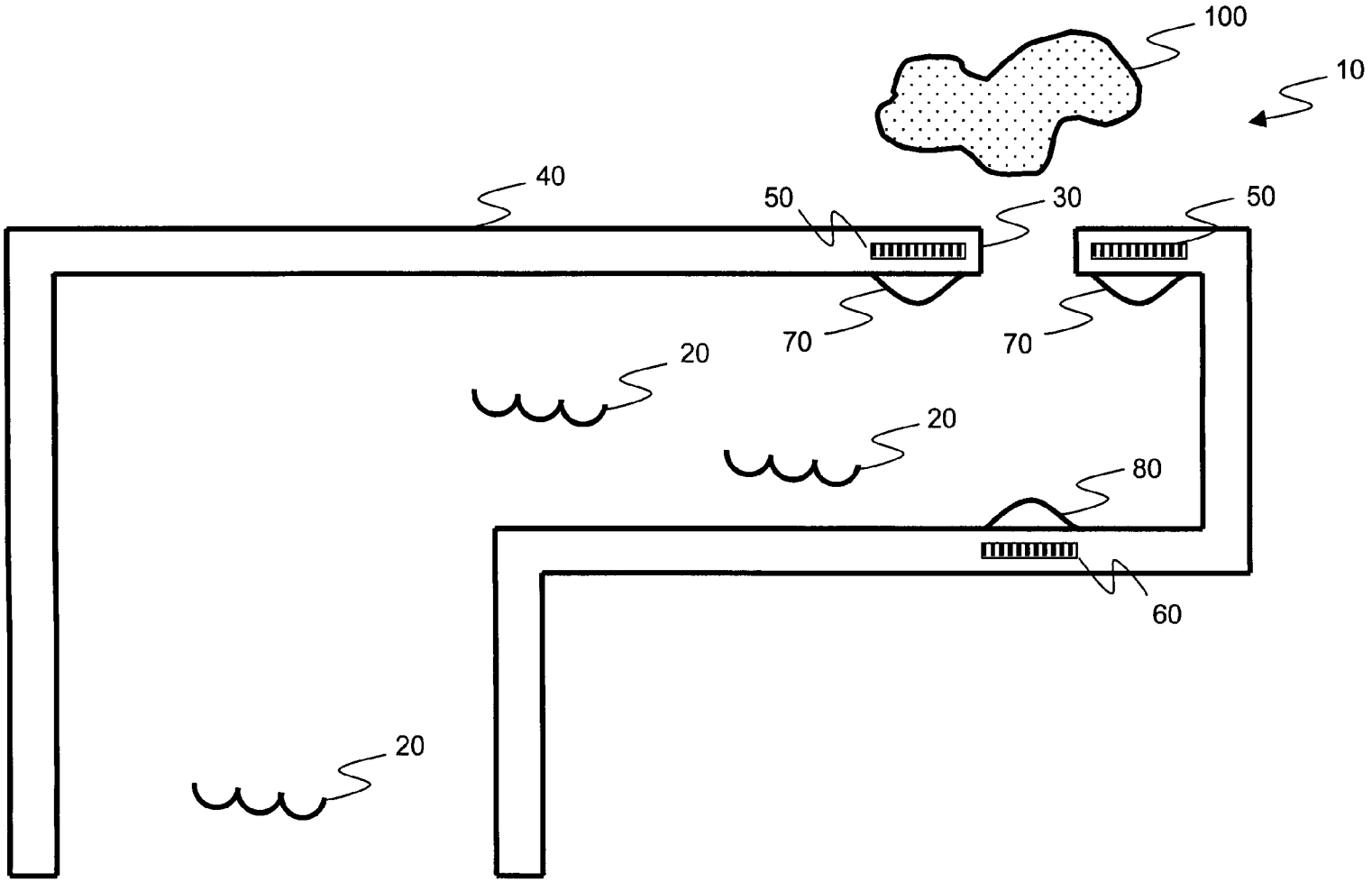
FIG. 1 is a cross-sectional view of an inkjet chamber.

Referring to FIG. 1, the drawing illustrates a cross-sectional view of an inkjet chamber 10, for an ink jet print head that contains ink 20 to be ejected from a nozzle 30 that is disposed upon a chamber roof 40. It should be noted at this point in time that the present invention contemplates the ejection of a multiplicity of possible fluids such as medicines, inks, pigments and the like. However, for purposes of clarity and consistency, fluids will be hereafter referred to as inks. Inkjet chamber 10 also contains a plurality of heaters including upper ejection heaters 50 and lower ejection heaters 60 depending upon the type of ejection mechanism used. If upper ejection heaters 50 were activated upper vapor bubbles 70 would be generated. This type of ejection methodology is generally referred to as a back-shooter. If the lower ejection heater 60 were activated a lower vapor bubble 80 would be generated. This type of ejection methodology is generally referred to as a roof-shooter. Upper ejection heaters 50 and lower ejection heater 60 as shown can be configured as a single heater or a plurality of heaters.

Figure 2:
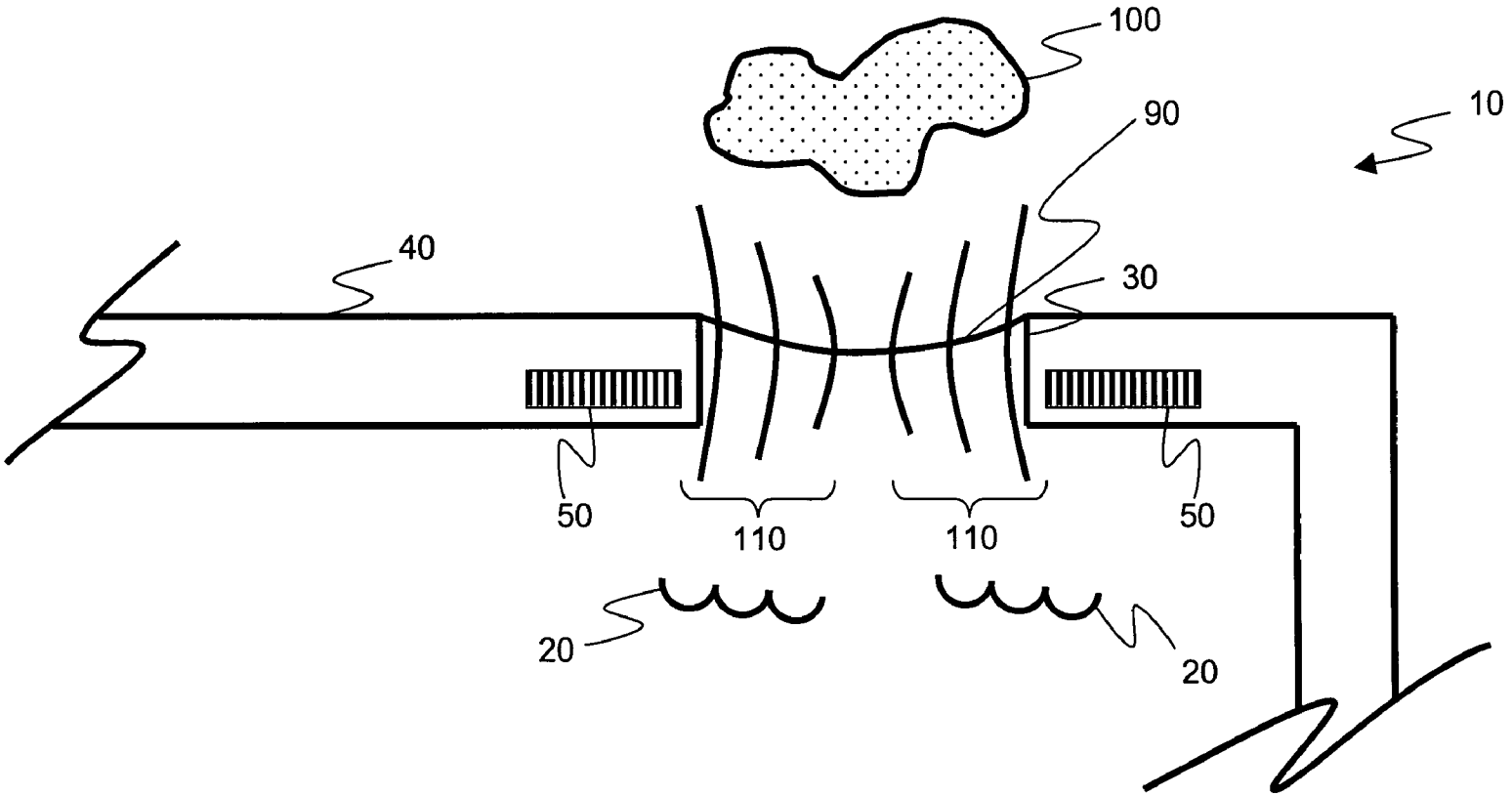
FIG. 2 is a partial cross-sectional view of the inkjet chamber showing the temperature gradient across a meniscus induced by heater(s)

Referring next to FIG. 2, the drawing illustrates a partial cross-sectional view of the inkjet chamber 10. A meniscus 90 of ink 20 that is formed within the nozzle 30 occurs at the interface of the ink 20 to the air 100 that resides outside the confines of the inkjet chamber 10. The interface that is represented by the meniscus 90 will dries over time when in contact with the air 100. This drying over time causes the ink 20 at the surface of the meniscus 90 to become progressively more concentrated as time passes until first the skinning and eventually the complete clogging of nozzle 30 occurs. Additionally, variations in viscosity of the ink will occur in layers through the ink (not shown) wherein the viscosity of the ink at the meniscus 90 is the thickest, with a gradual decrease in viscosity as the depth into the nozzle 30 increases. Activation of either or both of the upper ejection heaters 50 will result in the heating of the ink 20 at the meniscus 90 of the inkjet chamber 10.

Figure 7:
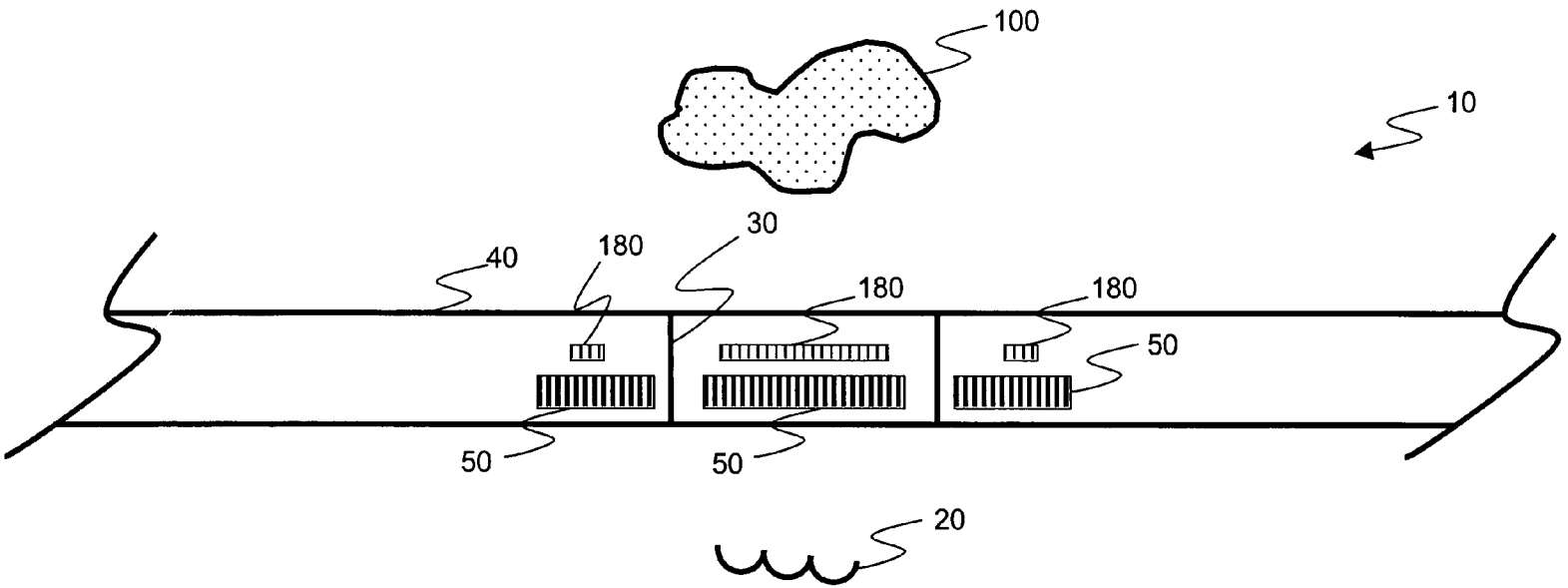
FIG. 7 is a partial cross sectional view of the nozzle plate of an inkjet chamber.

It is instructive to note that those skilled in the art should realize that in the discussion of ink stirring, the present invention deals specifically with ink 20 that is stirred by a flow induced at the meniscus 90 of ink 20. The stirring of the ink 20 is caused by the application of a sufficient amount of heat to create a sufficient surface tension gradient that in turn causes the ink 20 to flow at the meniscus 90 without the ink 20 being ejected from the inkjet chamber 10. Heat gradient lines 110 denote the heat gradient formed across the meniscus 90 of inkjet chamber 10. Upon actuation of either upper ejection heater 50, a decreasing heat gradient presents itself across the meniscus 90 of ink 20, with the ink being warmest at the edge of the meniscus 90 and cooler at the center of the meniscus 90. Heat gradient lines 110 are shown bent away from the decreasing heat gradient that is produced across the meniscus 90. It should be evident by those skilled in the art that the heaters used to cause stirring can comprise separate upper ejection heaters 50 along with circulation heaters 180 as shown in FIG. 7. Additionally the existing upper ejection heaters 50 can have secondary purpose and can be used as stirring elements. The application of a lower power to the upper ejection heaters 50 essentially causes heating at the meniscus 90 without causing ink 20 to be ejected from the inkjet chamber 10.

Figure 3:
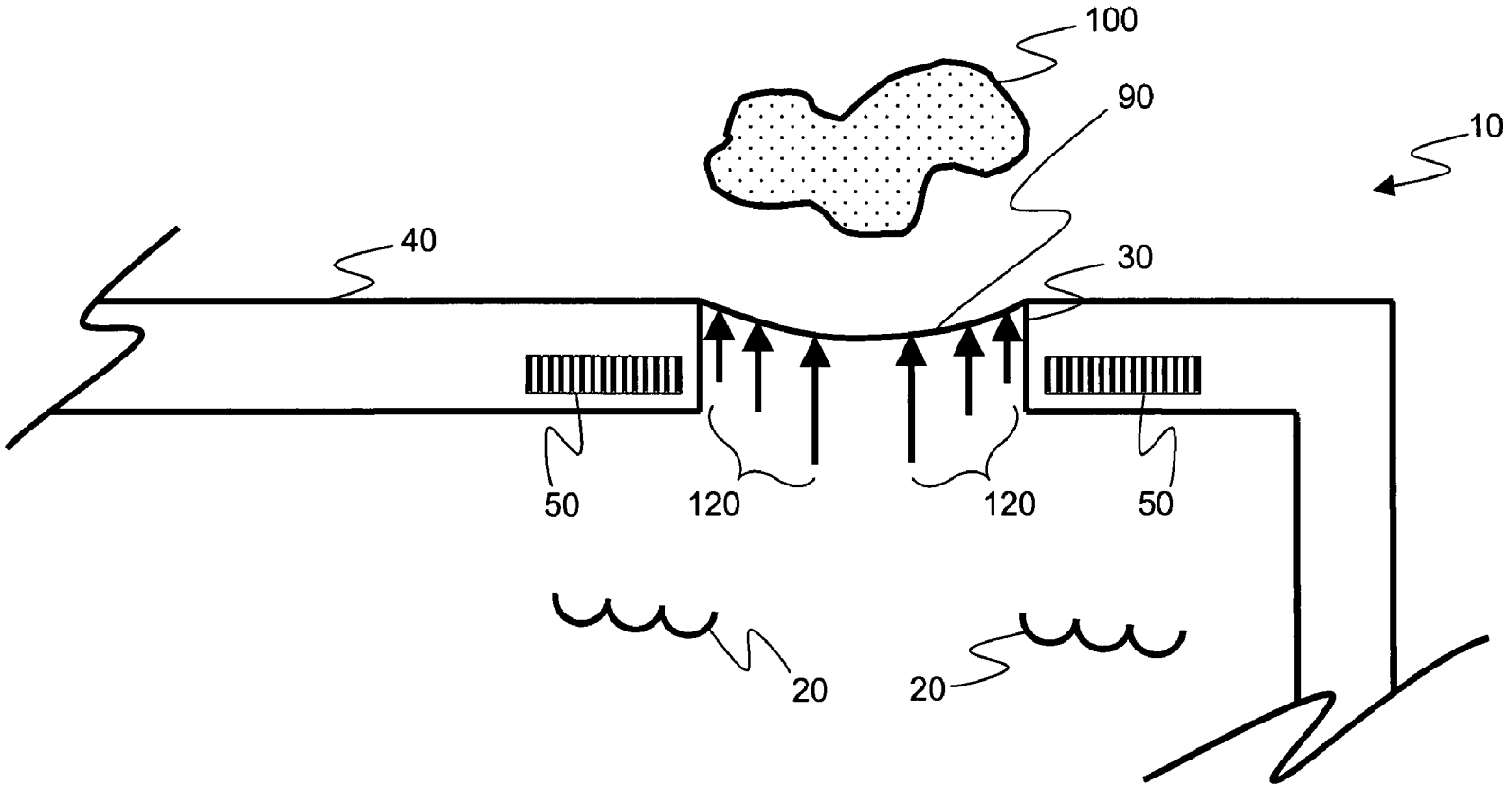
FIG. 3 is a partial cross-sectional view of the inkjet chamber showing the surface tension gradient across a meniscus.

Referring next to FIG. 3, the drawing illustrates a partial cross-sectional view of the inkjet chamber 10. A meniscus 90 of ink 20 that is formed within the nozzle 30 occurs at the interface of the ink 20 to the air 100 that resides outside the confines of the inkjet chamber 10. It is instructive to remember that as previously discussed in FIG. 2, the activation of either or both of the upper ejection heaters 50 will result in the heating of the ink 20 at the meniscus 90 that is present across the nozzle 30 of the inkjet chamber 10. The vertically diagrammed surface tension gradient arrows 120 denote the surface tension gradient present across the meniscus 90 of inkjet chamber 10. The gradient in surface tension represented by the surface tension gradient arrows 120 results from the application of the heating gradient represented by the heat gradient lines 110 discussed in FIG. 2. The surface tension across the meniscus 90 of inkjet chamber 10 varies as a function of the heat gradient across the meniscus 90 of inkjet chamber 10. The surface tension decreases in a liquid as temperature increases. That is to say that the heat gradient across the meniscus 90 of the inkjet chamber 10 is the inverse of the surface tension gradient across the meniscus 90 of inkjet chamber 10. Accordingly, while a heat profile that is induced by the application of the upper ejection heaters 50 across the meniscus 90 of inkjet chamber 10 increases from the edge of the meniscus 90 and decreases towards the center of meniscus 90, the surface tension gradient that results across the meniscus 90 of inkjet chamber 10 is lessened at the outside edge of meniscus 90 and increases towards the center of the meniscus 90 that is formed across nozzle 30.

Figure 4:
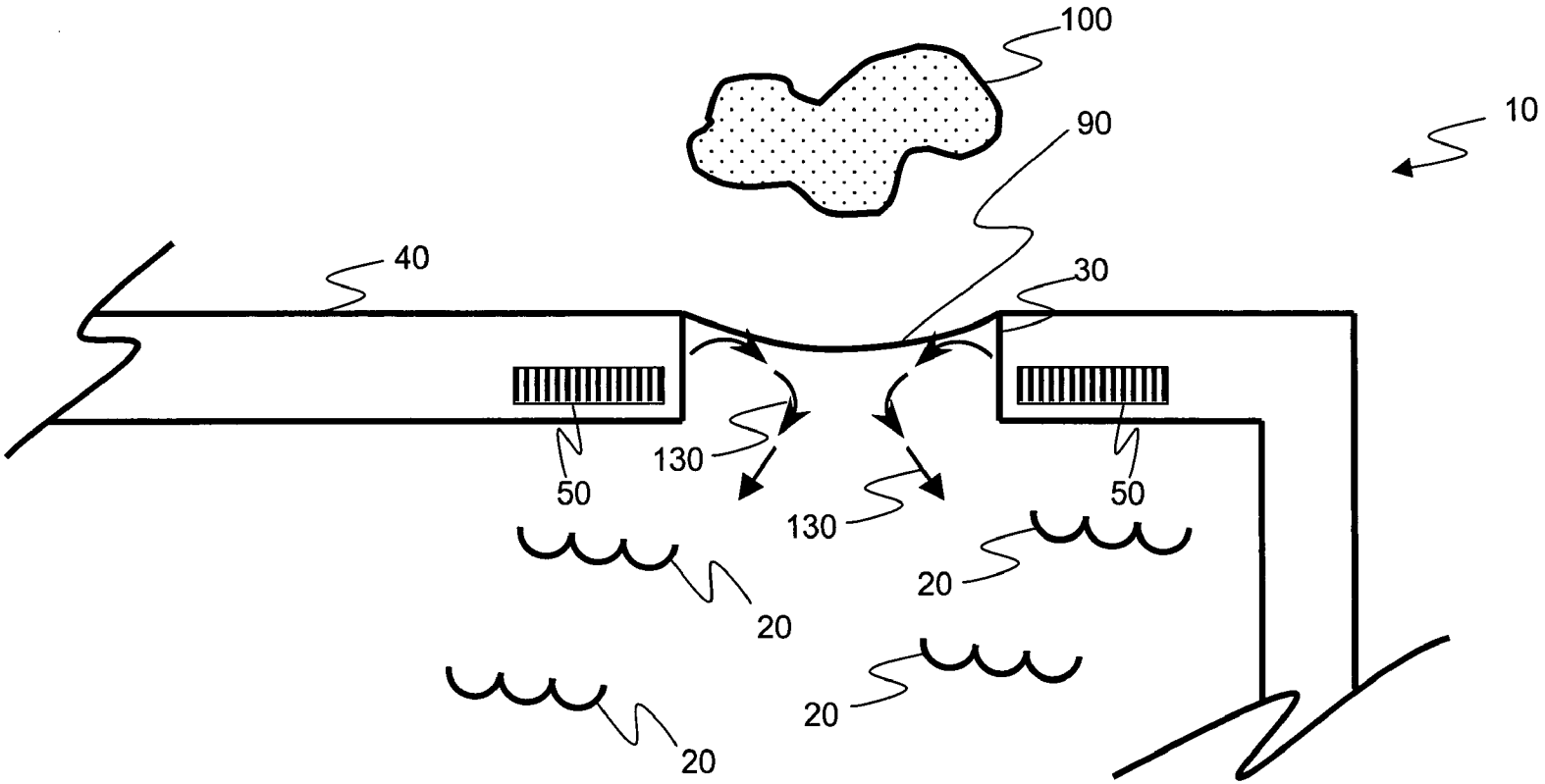
FIG. 4 is a partial cross-sectional view of the inkjet chamber showing the circulation of fluid that is induced within a nozzle.

Referring next to FIG. 4, the drawing illustrates a partial cross-sectional view of the inkjet chamber 10. A meniscus 90 of ink 20 that is formed within the nozzle 30 occurs at the interface of the ink 20 to the air 100 that resides outside the confines of the inkjet chamber 10. It is instructive to remember that as previously discussed in FIG. 2, the activation of either or both of the upper ejection heaters 50 results in the heating of the ink 20 at the meniscus 90 that is present across the nozzle 30 of the inkjet chamber 10. The circularly drawn circulation arrows 130 denote the circulation of the ink 20 that occurs within the nozzle 30 of inkjet chamber 10. Flow occurs in the ink 30 by virtue of the existence of a surface tension gradient 120 previously discussed in FIG. 3. This region of lower surface tension at the edge of nozzle 30 that gradually increases to a region of higher surface tension towards the center of nozzle 30 causes the flow diagrammed by circulation arrows 130. This flow occurs in the ink 20 and occurs from the region of lower surface tension at the edge of nozzle 30 to the region of higher surface tension towards the center of nozzle 30 due to heating performed by upper ejection heater 50 at the wall of the nozzle. As the ink 20 flows towards the interior of the meniscus, it results in a pressure increase towards the interior of the meniscus. This reduces the velocity of the ink 20 towards the interior of the meniscus. The ink 20 at this point is diverted towards the bulk interior that also includes ink 20, where it seeks this lower pressure region, thus creating the circulation pattern denoted by the circulation arrows 130. If the second upper ejection heater 50 are used on the right wall of nozzle 30, a plurality of timing sequences could be ultimately employed, a similar phenomenon will be experienced on the right side of the meniscus, thus resulting in a mirrored circulation pattern. The combination of the two circulation patterns or vortices enhances the fluid velocity at the center of the meniscus causing the ink to fall deeper into the bulk interior. It should be noted here that a plurality of heaters can also be employed depending upon engineering requirements.

Figure 5:
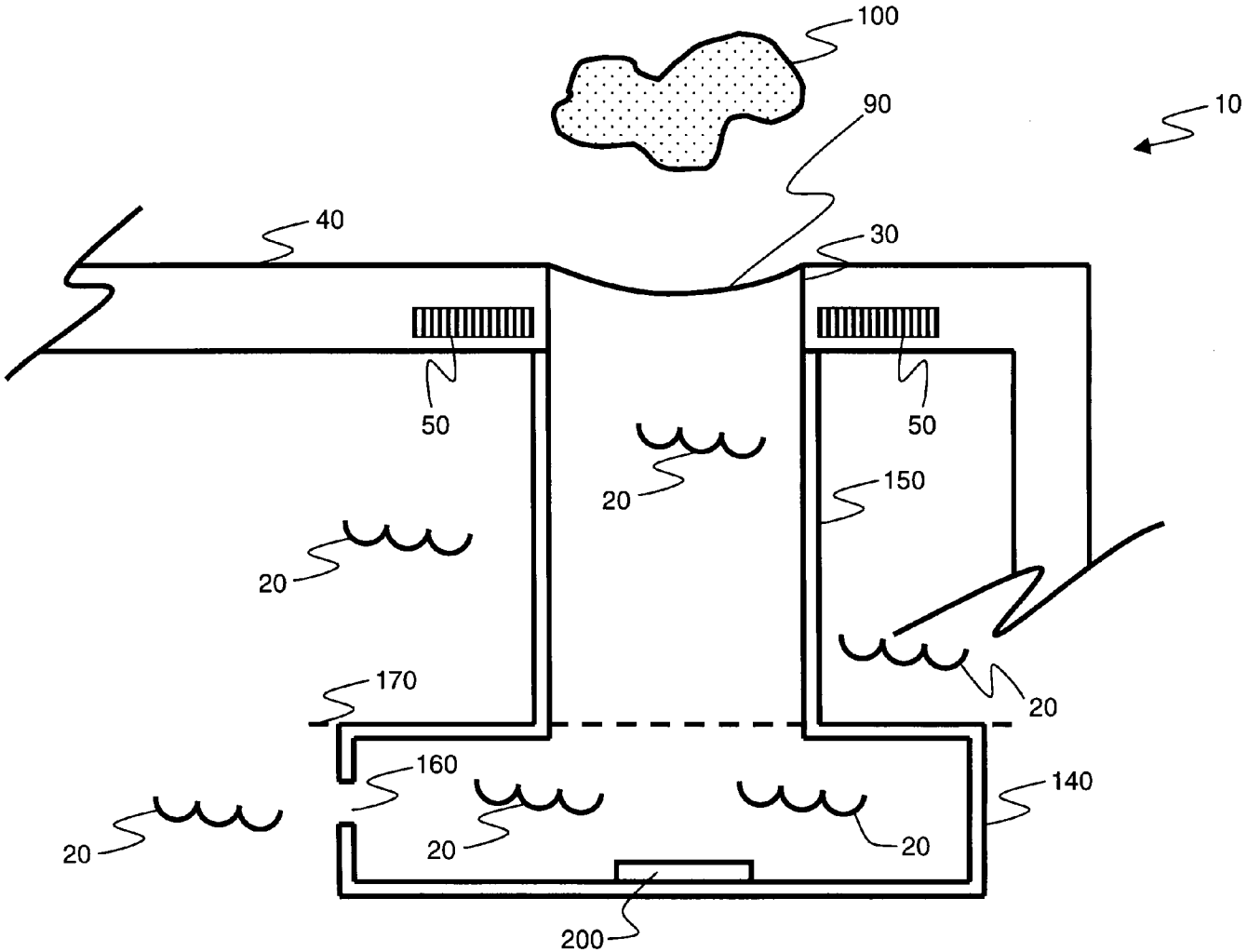
FIG. 5 is a partial cross-sectional view of the inkjet chamber.

Referring now to FIG. 5, the drawing illustrates a partial cross-sectional view of the inkjet chamber 10. A meniscus 90 of ink 20 that is formed within the nozzle 30 occurs at the interface of the ink 20 to the air 100 that resides outside the confines of the inkjet chamber 10. It should be readily evident to those skilled in the art that various types of mechanisms exist to eject ink 20 onto a medium such as paper. Typical ejection mechanisms such as fluid pumps, 200 such as fluid pumps, piezo-electric mechanisms, bi-metallic mechanisms, electrostatic mechanisms, mechanical mechanisms, and the like are all possible schemes that can be utilized for the ejection of ink 20. Actuator box 140 is attached to output tube 150. Output tube 150 is in turn affixed about nozzle 90 and connected to the chamber roof 40 of inkjet chamber 10. Dashed separation line 170 denotes the functional separation between actuator box 140 and output tube 150. This arrangement allows a flow of ink 20 to be possible through ink port 160, actuator box 140, and in turn through output tube 150 and nozzle 30. Since these various ejection mechanisms can be readily integrated with the mixing mechanism previously described in FIG. 5, one of ordinary skill will recognize that these mechanisms all share the benefits of this method of ink circulation.

Figure 6:
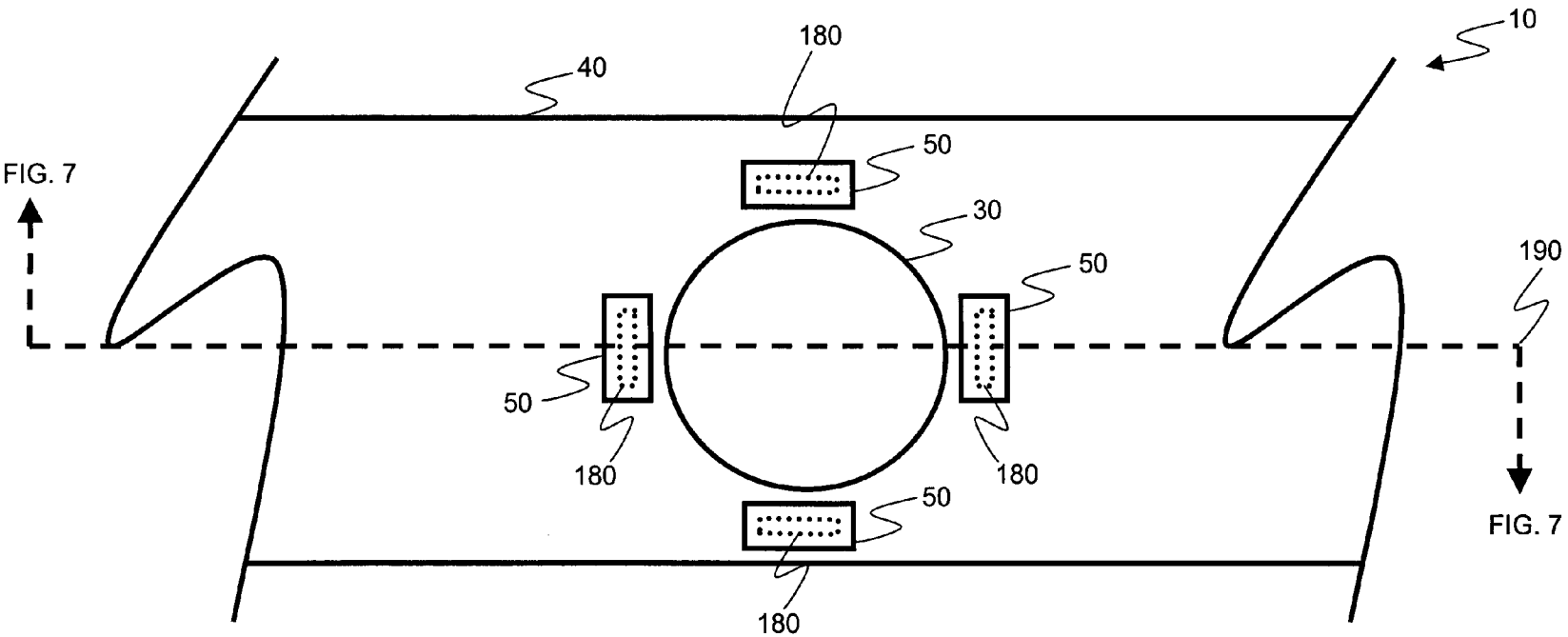
FIG. 6 is a partial top view of an inkjet chamber.

Referring next to FIG. 6, drawn is a partial top view of inkjet chamber 10. Chamber roof 40 incorporates nozzle 30, and upper ejection heaters 50. Also are shown two additional upper ejection heaters 50 diagrammed at 12:00 and 6:00 respectively. These are shown to illustrate that any plurality of heaters can be used depending on design needs and requirements. Shown within these upper ejection heaters 50 are shown the smaller circulation heaters 180. The smaller circulation heaters 180 are drawn of smaller size simply for clarity of the figures and could be either bigger, smaller or of identical size to the upper ejection heaters 50. A transition line 190 details a now permits a transition to FIG. 7.

Referring to FIG. 7, detailed is a partial cross sectional view of inkjet chamber 10 that is functionally and descriptively linked to FIG. 6. It is understood from the teachings of FIG. 4 that any plurality of upper ejection heaters 50 can actually be used due to variable design needs and requirements. It is also understood from the teachings of FIG. 6 that it is possible to also incorporate the any plurality of circulation heaters 180 into a circulation design, and these circulation heaters 180 can exist in variable sizes, along with co-existing concurrently with the upper ejection heaters 50. Both of these upper ejection heaters 50 and circulation heaters 180 can be placed above or below each other relative to the nozzle 30. They could additionally be placed in positions that are inside or outside each other relative to the nozzle 30. However, heaters that are equally placed relative to nozzle 30 are more effective that those that are not, because of the properties of heat transfer and fluid behavior.

The invention has been described in detail with particular reference to certain preferred embodiments thereof, but it will be understood that variations and modifications can be effected within the scope of the invention.

PARTS LIST

10 inkjet chamber
20 ink
30 nozzle
40 chamber roof
50 upper ejection heater
60 lower ejection heater
70 upper vapor bubble
80 lower vapor bubble
90 meniscus
100 air
110 heat gradient lines
120 tension gradient arrows
130 circulation arrows
140 actuator box
150 output tube
160 ink port
170 dashed separation line
180 circulation heaters
190 transition line

What is claimed is:

1. A liquid emitter comprising:

a structure defining a chamber adapted to provide a liquid and including an orifice through which a drop of the liquid can be emitted, the liquid being present as a meniscus at the orifice, the chamber including an interior;

a drop forming mechanism operatively associated with the chamber; and a mixing mechanism associated with the chamber and operable to create a surface tension gradient on the liquid provided by the chamber, wherein a liquid flow is induced by the mixing mechanism at the meniscus such that the liquid at the meniscus flows towards the interior of the chamber without being emitted from the chamber.

2. The liquid emitter of claim 1, wherein the drop forming mechanism is operatively associated with a portion of the chamber other than the portion of the chamber including the orifice.

3. The liquid emitter of claim 2, wherein the drop forming mechanism includes a heater.

4. The liquid emitter of claim 2, wherein the drop forming mechanism includes a piezoelectric crystal.

5. The liquid emitter of claim 2, wherein the drop forming mechanism includes an electrostatic actuator.

6. The liquid emitter of claim 2, wherein the drop forming mechanism includes a bi-metallic actuator.

7. The liquid emitter of claim 2, wherein the drop forming mechanism includes a liquid pump.

8. The liquid emitter of claim 2, wherein the mixing mechanism is associated with a portion of the chamber also including the orifice.

9. The liquid emitter of claim 8, wherein the mixing mechanism includes a heater.

10. The liquid emitter of claim 8, wherein the mixing mechanism includes a plurality of heaters positioned adjacent to the orifice as viewed from a cross sectional plane of the orifice.

11. The liquid emitter of claim 10, wherein the plurality of heaters are positioned on opposite sides of the orifice as viewed from a plane perpendicular to the orifice.

12. The liquid emitter of claim 10, wherein the plurality of heaters are positioned on opposite sides of the orifice as viewed from a plane perpendicular to the orifice.

13. The liquid emitter of claim 2, wherein the drop forming mechanism includes a mechanical actuator.

14. The liquid emitter of claim 2, wherein the drop forming mechanism includes an electrical actuator.

15. The liquid emitter of claim 1, wherein the drop forming mechanism is operatively associated with a portion of the chamber including the orifice.

16. The liquid emitter of claim 15, wherein the drop forming mechanism includes a heater.

17. The liquid emitter of claim 15, wherein the drop forming mechanism includes a plurality of heaters positioned adjacent to the orifice as viewed from a cross sectional plane of the orifice.

18. The liquid emitter of claim 17, wherein the plurality of heaters are positioned on opposite sides of the orifice as viewed from a plane perpendicular to the orifice.

19. The liquid emitter of claim 15, wherein the plurality of heaters are positioned on opposite sides of the orifice as viewed from a plane perpendicular to the orifice.

20. The liquid emitter of claim 15, wherein the mixing mechanism is associated with a portion of the chamber also including the orifice.

21. The liquid emitter of claim 20, wherein the mixing mechanism includes a heater.

22. The liquid emitter of claim 20, wherein the mixing mechanism includes a plurality of heaters positioned adjacent to the orifice as viewed from a cross sectional plane of the orifice.

23. The liquid emitter of claim 22, wherein the plurality of heaters are positioned on opposite sides of the orifice as viewed from a plane perpendicular to the orifice.

24. The liquid emitter of claim 22, wherein the plurality of heaters are positioned on opposite sides of the orifice as viewed from a plane perpendicular to the orifice.

25. The liquid emitter of claim 20, wherein the drop forming mechanism and the mixing mechanism are functionally interchangeable.

26. The liquid emitter of claim 20, wherein the drop forming mechanism and the mixing mechanism are a single device.

27. The liquid emitter of claim 20, wherein the drop forming mechanism and the mixing mechanism are distinct devices.

28. The liquid emitter of claim 20, wherein the mixing mechanism and the drop forming mechanism are positioned adjacent to the orifice as viewed from a cross sectional plane of the orifice and coplanar horizontally relative to each other.

29. The liquid emitter of claim 20, wherein the mixing mechanism and the drop forming mechanism are positioned adjacent to the orifice as viewed from a cross sectional plane of the orifice and coplanar vertically relative to each other.

30. The liquid emitter of claim 20, wherein the mixing mechanism and the drop forming mechanism are positioned adjacent to the orifice and coplanar relative to each other as viewed from a plane perpendicular to the orifice.

31. A method of mixing a liquid comprising:

providing a liquid in a chamber including an orifice through which a drop of the liquid can be emitted, the liquid being present as a meniscus at the orifice, the chamber including an interior; and creating a surface tension gradient on the liquid provided by the chamber, wherein a liquid flow is induced by the mixing mechanism at the meniscus such that the liquid at the meniscus flows towards the interior of the chamber without being emitted from the chamber.

32. The method of claim 31, wherein creating a surface tension gradient on the liquid provided by the chamber comprises heating the liquid in the chamber.

33. The method of claim 32, wherein heating the liquid in the chamber includes heating at least a portion of the liquid located at the orifice of the chamber.

34. The method of claim 32, wherein heating the liquid in the chamber includes heating at least a portion of the liquid located in the chamber away from the orifice.

35. The method of claim 32, wherein heating the liquid in the chamber includes heating at least a portion of the liquid in a location of the liquid at a meniscus of the liquid.

36. The method of claim 32, wherein heating the liquid in the chamber includes heating at least a portion of the liquid in a location of the liquid proximate to a meniscus of the liquid.

37. The method of claim 32, wherein heating the liquid in the chamber includes heating at least a portion of the liquid in a location of the liquid other than at a meniscus of the liquid.

38. The method of claim 32, wherein heating the liquid in the chamber includes heating the liquid in multiple locations of the liquid.

39. The method of claim 38, wherein heating the liquid in multiple locations of the liquid comprises heating the liquid in each location in an alternating fashion.

40. The method of claim 38, wherein heating the liquid in multiple locations of the liquid comprises heating the liquid in each location in an irregular fashion.

41. The method of claim 38, wherein heating the liquid in multiple locations of the liquid comprises heating the liquid in each location in a regular fashion.

42. The method of claim 38, wherein heating the liquid in multiple locations of the liquid comprises heating the liquid in each location at the same time.

43. A method of printing comprising: providing a liquid in a chamber including an orifice through which a drop of the liquid can be emitted, the liquid being present as a meniscus at the orifice, the chamber including an interior;

providing a drop forming mechanism operatively associated with the chamber;

mixing the liquid in the chamber by creating a surface tension gradient on the liquid provided by the chamber, wherein a liquid flow is induced by the mixing mechanism at the meniscus such that the liquid at the meniscus flows towards the interior of the chamber without being emitted from the chamber; and ejecting a drop of the liquid from the orifice of the chamber using the drop forming mechanism.

44. The method of claim 43, wherein creating a surface tension gradient on the liquid provided by the chamber comprises heating the liquid in the chamber.

45. The method of claim 44, wherein heating the liquid in the chamber includes heating at least a portion of the liquid located at the orifice of the chamber.

46. The method of claim 44, wherein heating the liquid in the chamber includes heating at least a portion of the liquid in a location of the liquid at a meniscus of the liquid.

47. The method of claim 44, wherein heating the liquid in the chamber includes heating at least a portion of the liquid in a location of the liquid proximate to a meniscus of the liquid.

48. The method of claim 44, wherein heating the liquid in the chamber includes heating the liquid in multiple locations of the liquid.

49. The method of claim 48, wherein heating the liquid in multiple locations of the liquid comprises heating the liquid in each location in an alternating fashion.

50. The method of claim 43, wherein ejecting a drop of the liquid from the orifice of the chamber using the drop forming mechanism comprises heating the liquid.

51. The method of claim 50, wherein heating the liquid includes heating at least a portion of the liquid located proximate to the orifice of the chamber.

52. The method of claim 50, wherein heating the liquid includes heating at least a portion of the liquid located in the chamber away from the orifice.

53. The method of claim 43, wherein ejecting a drop of the liquid from the orifice of the chamber using the drop forming mechanism comprises acting upon the liquid in a mechanical fashion.

54. The method of claim 43, wherein ejecting a drop of the liquid from the orifice of the chamber using the drop forming mechanism comprises acting upon the liquid in a electrical fashion.

* * * * *